US008480278B2

(12) United States Patent
Wasem

(10) Patent No.: US 8,480,278 B2
(45) Date of Patent: Jul. 9, 2013

(54) DECORATIVE LIGHTING STRAND AND METHOD OF ASSEMBLING AND INSTALLING SAME

(75) Inventor: Leslie Wasem, Johnson City, TN (US)

(73) Assignee: Wellspring Innovations, LLC, Johnson City, TN (US)

( * ) Notice: Subject to any disclaimer, the term of this patent is extended or adjusted under 35 U.S.C. 154(b) by 33 days.

(21) Appl. No.: 12/669,029

(22) PCT Filed: Dec. 13, 2007

(86) PCT No.: PCT/US2007/025587

§ 371 (c)(1), (2), (4) Date: Jan. 13, 2010

(87) PCT Pub. No.: WO2009/014529

PCT Pub. Date: Jan. 29, 2009

(65) Prior Publication Data

US 2010/0195332 A1 Aug. 5, 2010

Related U.S. Application Data

(60) Provisional application No. 60/962,253, filed on Jul. 25, 2007.

(51) Int. Cl.
*A41G 1/00* (2006.01)

(52) U.S. Cl.
USPC ..... 362/568; 362/654

(58) Field of Classification Search
USPC ..... 362/567, 568, 249.06, 249.16–249.19, 362/653, 654
See application file for complete search history.

(56) References Cited

U.S. PATENT DOCUMENTS

| | | | | |
|---|---|---|---|---|
| 377,843 | A * | 2/1888 | Schering | 73/223 |
| 1,843,389 | A * | 2/1932 | Fischer | 439/505 |
| 4,736,282 | A * | 4/1988 | Ahroni | 362/123 |
| 5,245,519 | A | 9/1993 | Openiano | |
| 6,142,429 | A * | 11/2000 | Ahroni | 248/74.2 |
| 6,224,231 | B1 * | 5/2001 | Personius | 362/123 |
| 6,636,766 | B2 * | 10/2003 | Bornzin et al. | 607/19 |
| 7,152,998 | B2 * | 12/2006 | Rahman | 362/249.19 |
| 2004/0012950 | A1 * | 1/2004 | Pan | 362/123 |
| 2005/0024871 | A1 * | 2/2005 | Wu | 362/252 |
| 2007/0195516 | A1 * | 8/2007 | Cheng | 362/123 |

FOREIGN PATENT DOCUMENTS

GB 2386181 A 9/2003

* cited by examiner

*Primary Examiner* — Julie Shallenberger
(74) *Attorney, Agent, or Firm* — HolzerIPLaw, PC

(57) ABSTRACT

A decorative lighting strand for decorating a surface having a limb with a branch extending from the limb, where the strand has a length of wire connecting a plurality of decorative bulbs and midway the strand there is a hub which can be secured on the limb so that the strand can be extended from the hub along the branch from each side of the limb, and the invention includes multiple such strands electrically connected together each of which can be arranged in a horizontal plane of the surface. The invention also includes the method of decorating a surface with one or more such lighting strands which includes the steps of attaching the hub midway the length of the strand to the limb and extending the strand along one or more branches from each side of the hub.

19 Claims, 13 Drawing Sheets

FIG. 1
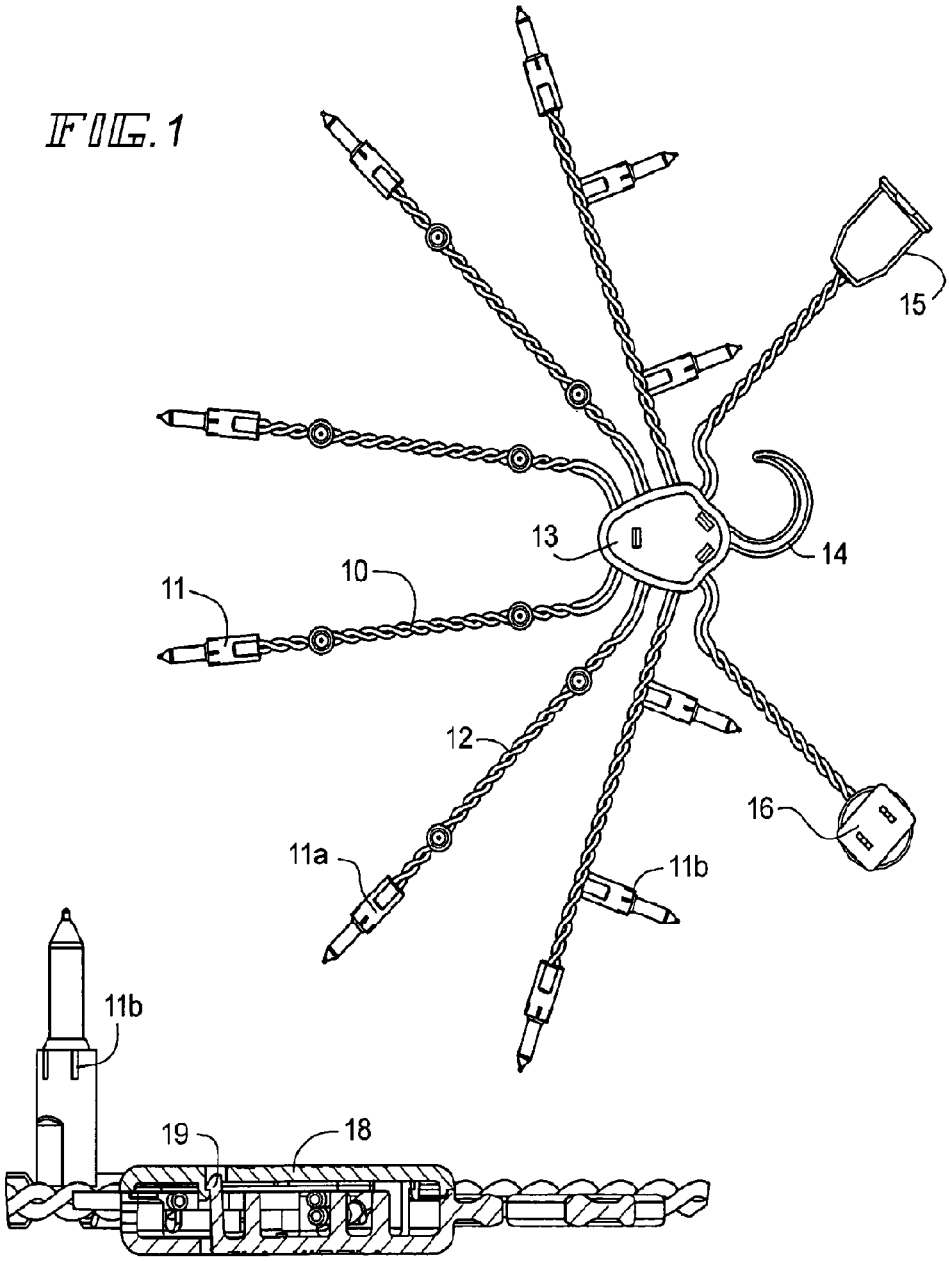
FIG. 3
FIG. 2
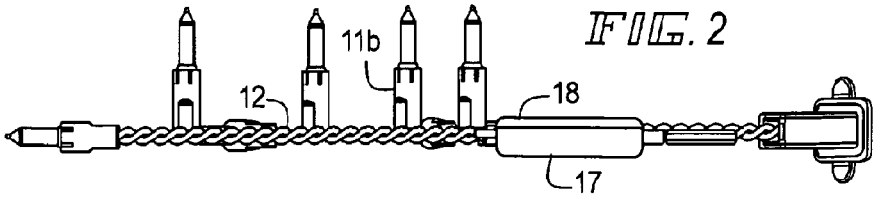

FIG. 5
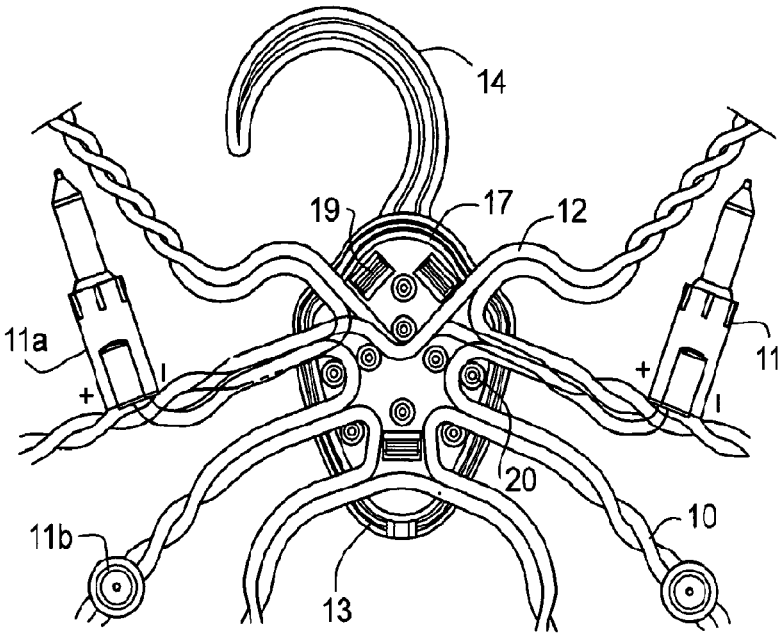
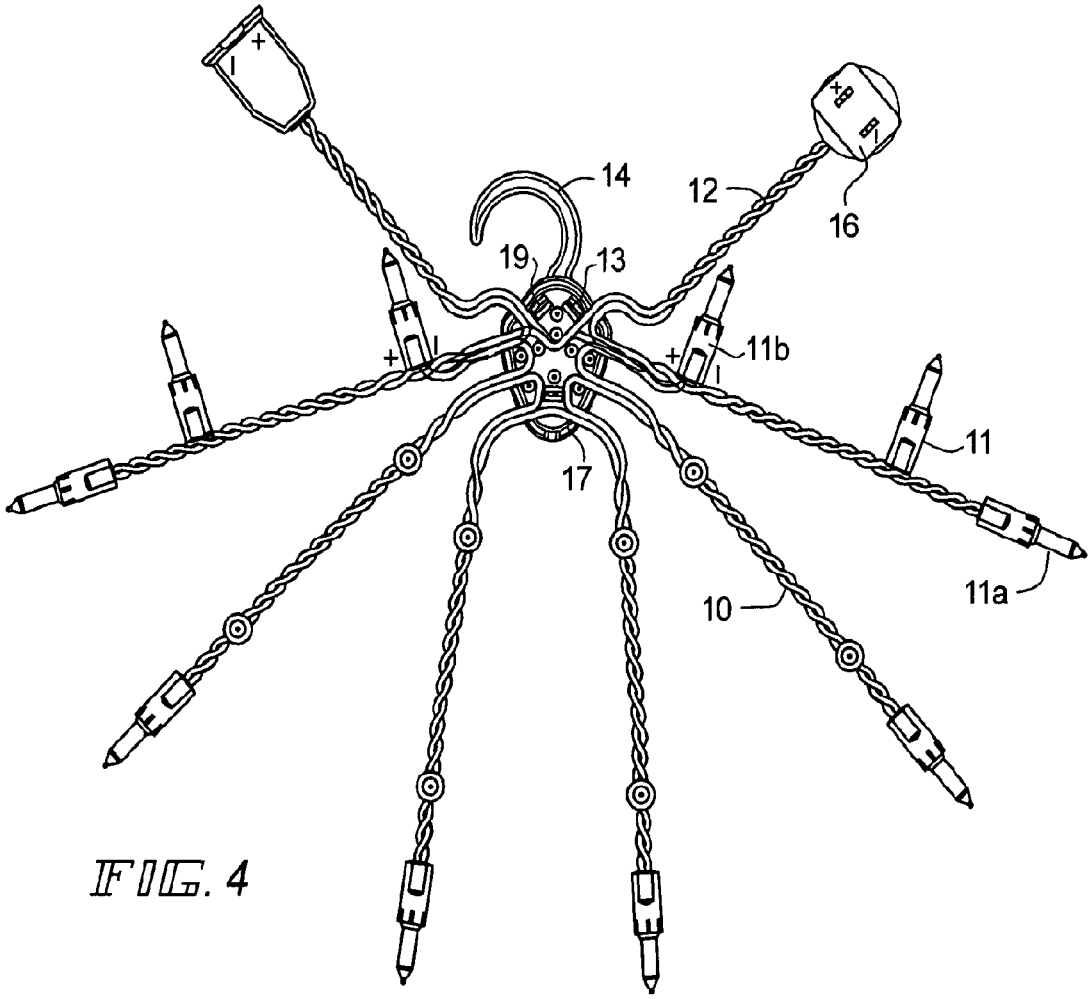
FIG. 4

FIG. 11
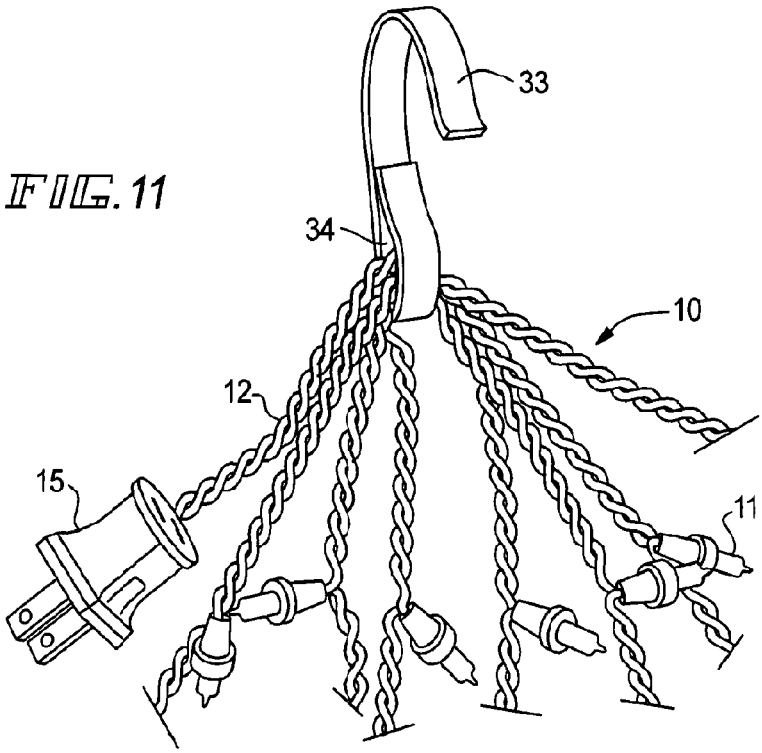
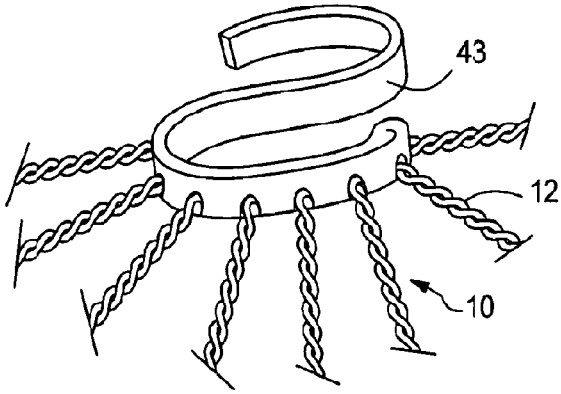
FIG. 12
FIG. 13
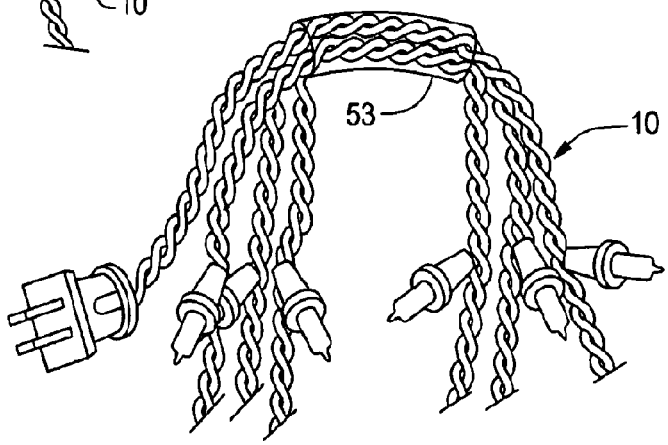

DECORATIVE LIGHTING STRAND AND METHOD OF ASSEMBLING AND INSTALLING SAME

This invention related to a decorative lighting strand and a method of assembling and installing the same, and particularly relates to lighting stands useful in holiday decorations especially for Christmas tree and like uses.

BACKGROUND OF THE INVENTION

Conventional lighting systems for holiday and similar decoration have many inherent problems, for example:

Safety

The National Fire Protection Association reported that in the years 2000-2004, 1500 Christmas tree fires caused 70 deaths, 105 injuries and $84,000,000 in direct property damage, resulting from real and artificial trees. According to the US Fire Administration Department of Homeland Security, home decorations and holiday season fires resulted in 2,600 fires and loss of $930,000.000.

These losses were in great part attributable to frayed wires, bare spots, gaps in insulation, broken or cracked sockets, and excessive kinking or wear of wires before putting them up. Often these loses resulted from the use of long lengths of light strands, which frequently became tangled, particularly when stored and reused from year to year, and the lights sometimes became shorted when stored or twisted in a conventional fashion damaging the wires as they were applied both vertically and horizontally over the surface of the tree or other areas.

Positioning and Applying of Lights

Conventionally, most holiday decorators start at the top of the tree or other surface. The long strands of lights, which are frequently tangled, are twisted to accommodate the surface on which they are applied, and usually moved circularly around the surface to be decorated and then downwardly on another level of the surface or tree. This positioning of the lights usually requires two hands to accomplish and, even then, the decorator's motions are contortions to accommodate the surface to be decorated. While most fire authorities recommend that only three strands of lights be connected, to fully decorate the surface additional strands are frequently required and they are usually connected in series or from the same outlet, sometimes even those precautions result in an overload and fire hazard, and many people connect more than three strands together.

The alignment of the lights on a strand can also be a problem, because the bulb may not be in a proper position, frequently because the twisting application of the strand on the surface. For example, if the bulb should be oriented vertically, and the wire are twisted, the bulb will certainly be canted in an undesirable position.

A conventional lighting string requires the decorator to find the beginning, middle and end of the strand, and typically, that is not only difficult but also frustrating as the strands are normally intermixed. With the strands embodying the present invention, there is always a focal point or center for decorating a surface, because the hook or hub provides a starting point for the decoration.

Storing of the Lights

To prepare for storage, the wires must be untwisted and followed over the entire surface and that removal process can be difficult and frequently results in unseen hidden damage to the strand of lights, which is often not notices until the decoration job is completed—and then the strands must be removed, repaired or replaced and the tree or surface must be decorated again.

A great deal of damage can be done to conventional light strands when they are stored from year to year. For example, the wires and lights become twisted and often stuck to one another in an undesirable fashion, putting particular stress on the wires and bulbs and making the separating of the strand for application difficult—and sometime hazardous.

Damage caused by storage of conventional light strands may not be noticed from year to year, and if a short result, it may not be seen. Seemingly small shorts in conventional light strands are particularly hazardous when the strand is applied to an artificial tree, because a short can make the entire tree dangerous.

Creativity of Design

The difficulties in handling and designing decorations using conventional light strands is apparent from the foregoing discussion, because such strands are usually very long, and the movement of the decorator in applying the strand around the tree is inconvenient, stressful, and difficult, and the result is often unattractive. An improper arrangement of the lights on the surface will not only be dangerous, but also may not be attractive, especially where hot or empty spots on the decorated surfaces result. These problems are often not visible until the entire surface has been trimmed, and then the job must be done anew.

SUMMARY OF THE PRESENT INVENTION

In the present invention, a relatively short light strand, usually able to accommodate only a single branch of a trees or a single surface of the areas to be decorated only in either a selected horizontal or vertical mode, but usually not in both directions. Strands may be bundled together and joined together centrally or in a selected manner, so that they may radiate outwardly from the center of a tree or other surface. Each limb has its own light strand, and the strand is arranged so that lights may radiate outwardly from the innermost part of a tree to the outermost point of a branch. When the lights are arranged in the selected fashion, they are oriented in a desired position The individual light bulbs in each strand of lights are connected in a series, so that in the event of a loss of a light on the strand. a shunt kicks in and permits the other lights in the strand to be lit. Additionally, each stand may carry a male plug and female socket, so that the strand may be connected to a source of power, and the strand may be connected to another strand. Furthermore, each strand may have a fuse, or circuit breaker to disconnect that strand in the event of an overload, so that there is less danger of an overload or shorting.

The center of grouped strands may be connected by a hub-like device and hook or other means for engaging a selected trunk, limb, tree surface, post or other member. This structure permits the decorator to pull the strand against a hook or the like permitting the strand to be straightened and making the bulbs oriented in an upright position. No electrical connection is required within the novel hub-like device disclosed in this application, and such a hub, as disclosed, may be provided which will not place undue strain on the strand of lights. A soft, twistable, bendable non-conductive plastic tie fastener member may also be arranged adjacent to one or more bulbs on a strand, so that the strand may be attached to a selected surface to be decorated in a selected manner.

The structure and arrangement of the light strand described makes decoration of the surface easier, and permits easy removal of a strand by disconnecting any connected lights and disconnecting the hub from the engaged limb. Once removed, the strand may be hung from a hook or stored in a box or bag for reuse the next season. The strands are not tangled and easy to extend for reuse.

When the strands are used and stored as described, optimal positioning of the lights on the selected surface is provided. The decorator may avoid cross overs to provide better placement. Wires are less noticeable, and only arranged on assigned branches so that the arrangement is cleaner, neater and more symmetrical. If a strand or single bulb must be repaired, only the affected strand or bulb is involved. If multiple colors are desired, either strands of different uniform color may be used or a single strand may be provided with different colored lamps within the strand, leaving all these decorative decisions to the decorator, depending upon the decorator's vision of the completed decoration. By use of the present invention, the decorator is not confined by the light strands, but in fact the strands embodying the present invention liberates the decorator and encourages creativity.

Where the strands of lights are to be used for a predetermined decorative purpose, as for example, to trim a tree of predetermined size and/or shape, the strands may be packaged as a kit, with strands of various lengths and light and plug arrangements, so that the top of the tree may be decorated with a shorter strand and the other parts of the tree may be decorated with strands of longer lengths, and each strand may have included male and/or female plugs for electrically joining the strands together, so that the lowest or end strand can be conveniently connected to a source of power.

OBJECTS AND ADVANTAGES OF THE INVENTION

It is the object of the invention to provide a novel decorative lighting strand of the character described.

Another object is to provide a method of assembling and installing one or more decorative lighting strands of the character described.

Another object is to provide means for removably securing a decorative lighting strand to a limb-like surface on the object to which the strand is applied and to extend the strand vertically or horizontally from said surface.

Another object is to provide a removably securable hub or similar attachment means and multiple decorative lighting strands extending from said attachment means.

Another object is to provide directional elements on such a hub or similar attachment means for selectively directing strands of decorative lighting from said attachment means.

Another object is to orient lights on said decorative lighting strand in a predetermined selected manner.

Another object is to connect like strands of decorative lighting to one another, and to provide breaker or fuse means to prevent electrical overloads or shorts on a strand.

Another object is to provide one or more bulbs, fastener elements or ornaments on a strand of decorative lighting.

Another object is to utilize a strand of lights embodying the invention as a repair kit for pre-lit Christmas trees which require repair.

Another object is to provide strands of decorative lighting which may accommodate specialty decorations on said strand in a predetermined position or arrangements.

Another object is to provide a decorative lighting strand which is easy to produce and use in a safe and efficient manner on a Christmas tree or other surface and which can facilitate removal and storage of the decoration at a selected time, without damage to the strand or its parts.

Another object is to provide a versatile system for easy, efficient and attractive decorating of a Christmas tree or other surface in an expedient and versatile manner.

These and other objects and advantages will become more apparent as this description proceeds, taken in conjunction with the accompanying drawings.

BRIEF DESCRIPTION OF THE DRAWINGS

In the drawings:

FIG. 1 is a top plan view of a preferred bundle of strands of lights embodying the present invention having a preferred hook and hub and male plug and female socket arrangements.

FIG. 2 is a side view of the bundle of strands of lights shown in FIG. 1.

FIG. 3 is an enlarged sectional view of the hub and hook arrangement shown in FIG. 2

FIG. 4 is a view similar to FIG. 1, except with the preferred hub arrangement shown open and without its cover.

FIG. 5 is an enlarged view of the hub arrangements shown in FIG. 4, with parts of the strands broken away.

FIG. 11 is a perspective view of a modified bundle of light strands connected by a modified hook arrangement, where each strand may be moved slightly.

FIG. 12 is a perspective view of an alternative modified "S" type hook for the bundle of light strands and a part of the light strands attached to it.

FIG. 13 is a perspective view of another alternative modified bundle of light strands joined together by a molded on sleeve.

FIG. **16*a*** is a view showing branches decorated according to the present invention, with multiple strands connected to the branches.

Figure 17:
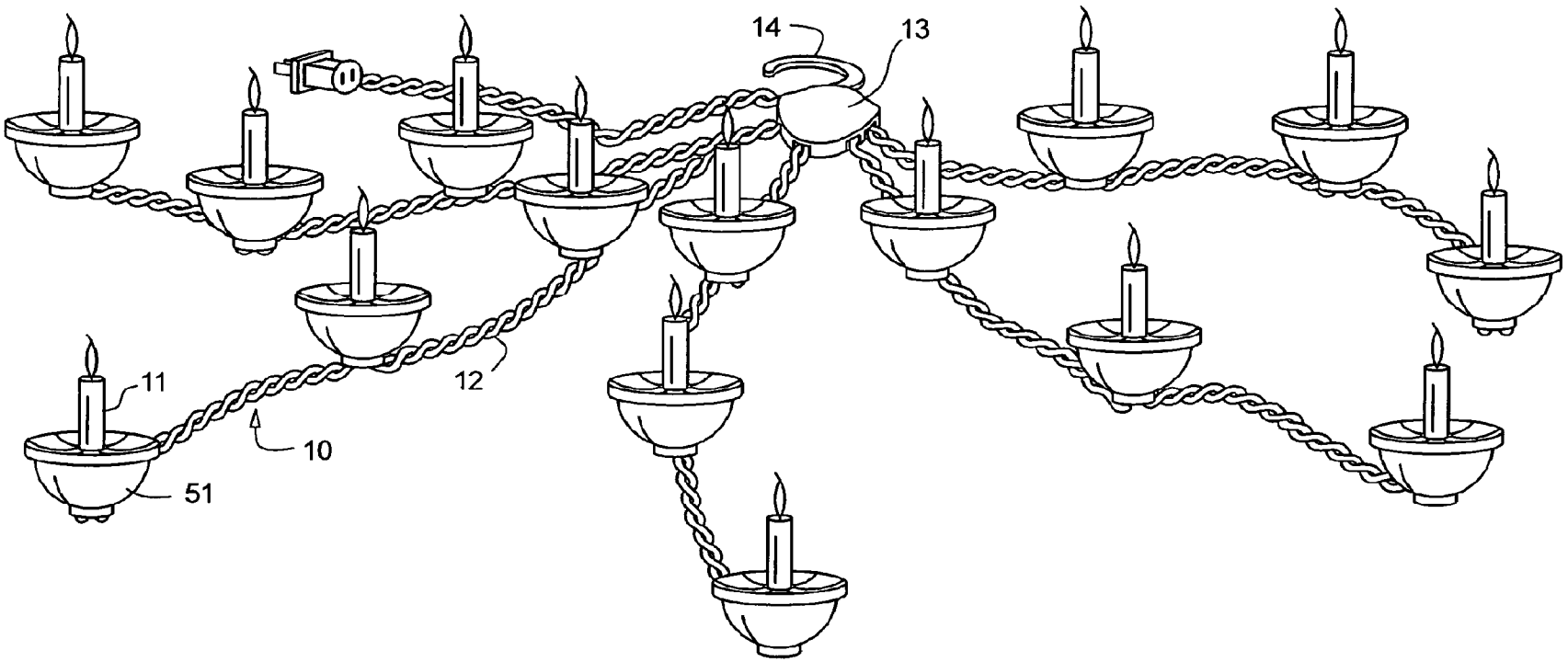

FIG. 17 is a bundle of strands having special lights or ornaments which are oriented relative to the connecting wires, so that special effects may be had where the lamps have special decorative features.

Figure 18:
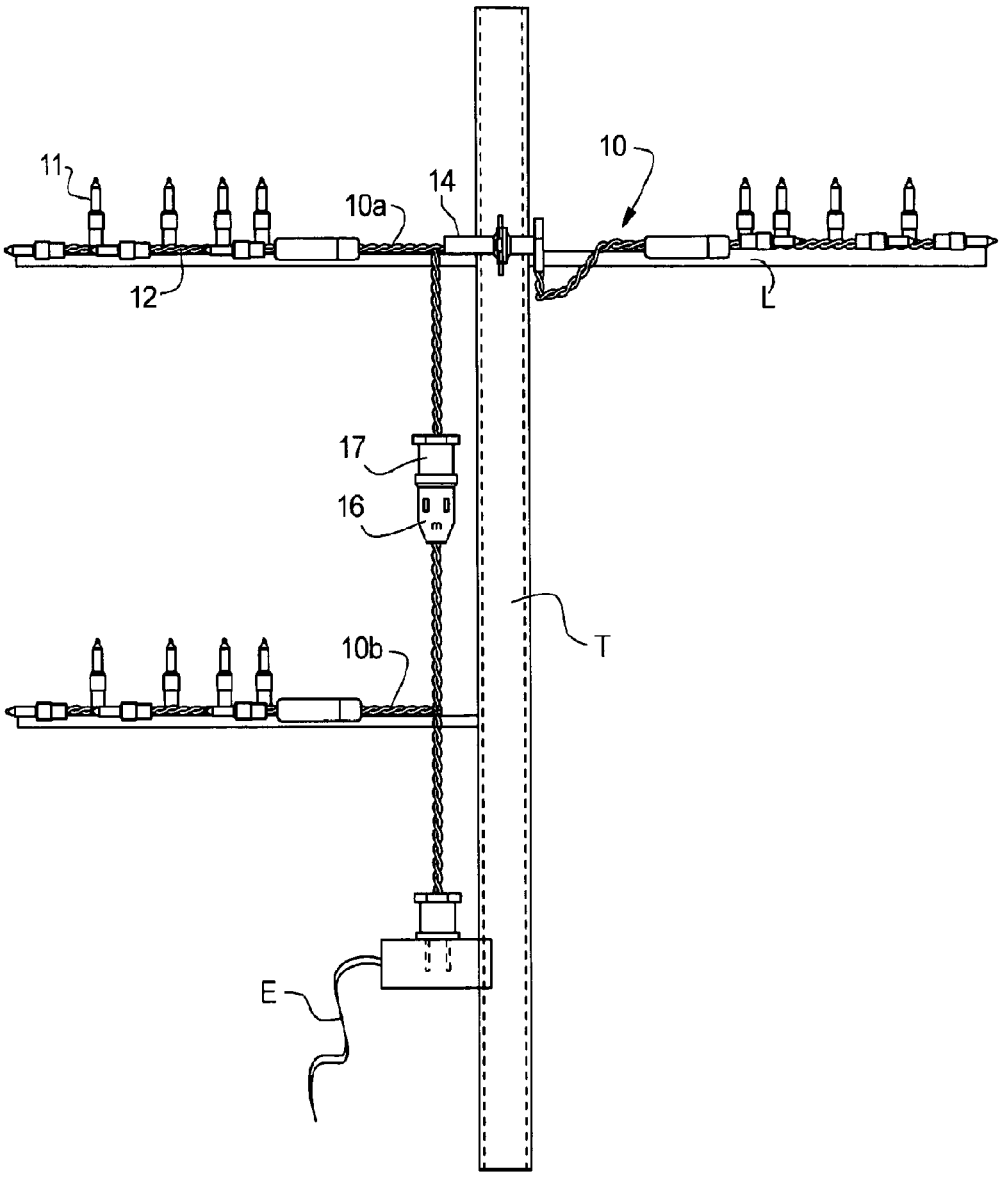

FIG. 18 is a schematic view showing two strands of lights embodying the present invention connected and secured on a pair of space apart limbs extending from and along a central post or limb, with the male plug and female socket plus of the strands engaged together and another plug connected to a source of power.

Figure 19:
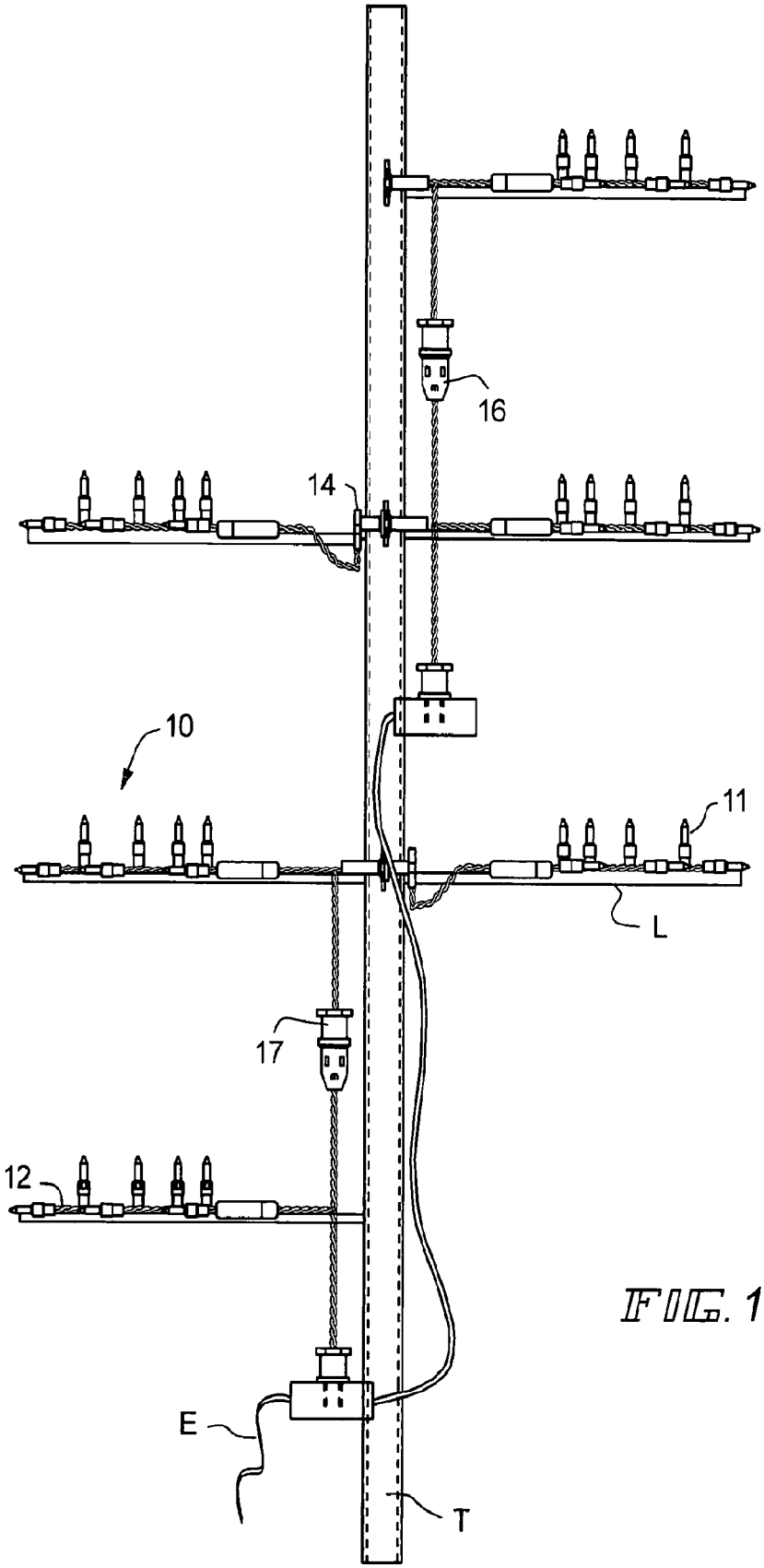

FIG. 19 is a schematic view similar to FIG. 18, except showing multiple stands of lights connected.

Figure 20:
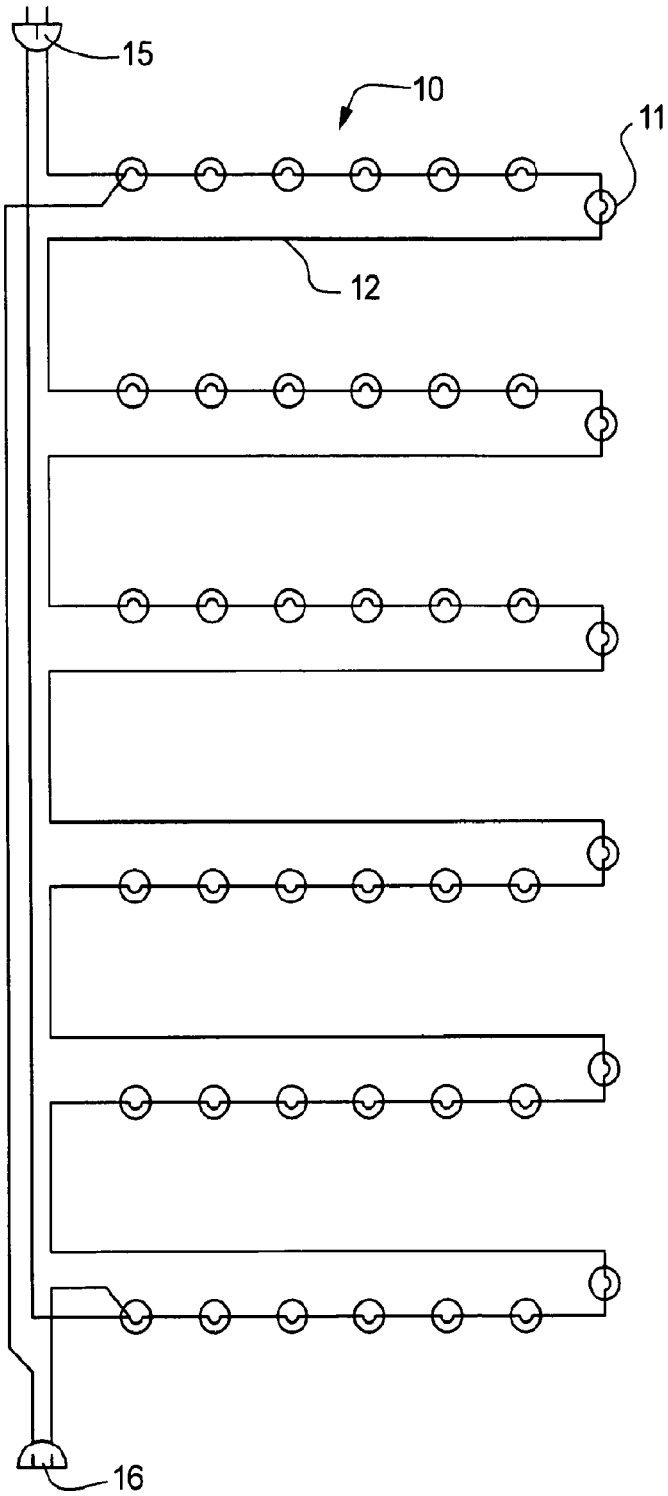

FIG. 20 is a circuit for a typical strand of lights embodying the present invention.

Figure 21:
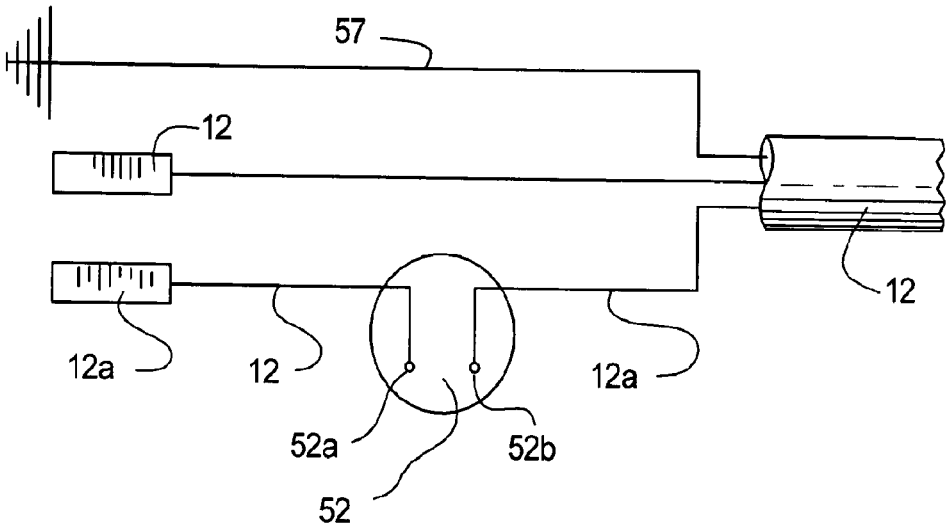

FIG. 21 is a typical plug or socket having a circuit breaker, fuse or switch which may be incorporated into the circuit, so that excessive power will cause the breaker or switch to break the line before an overload occurs.

Figure 22:
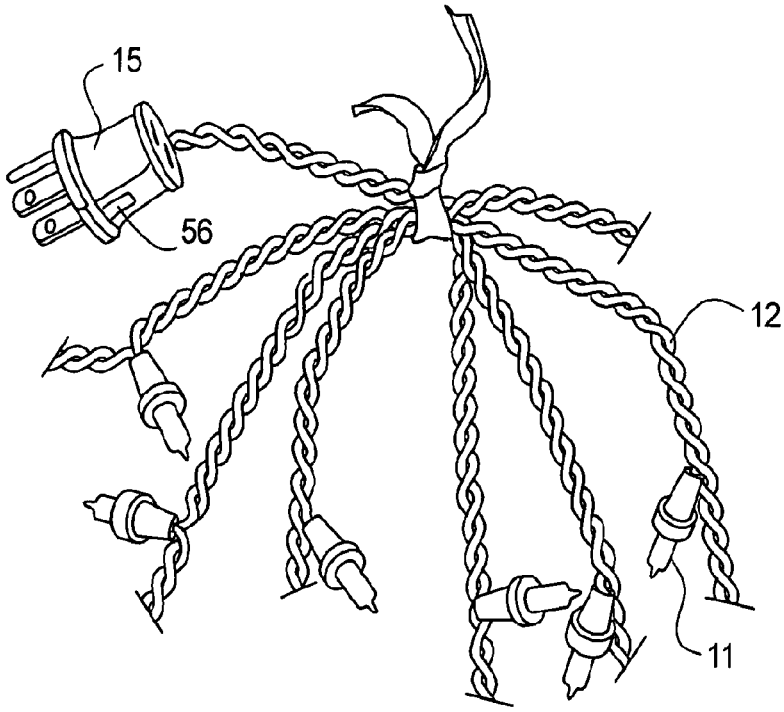

FIG. 22 is a perspective view of part of a bundle of light strands embodying the present invention, illustrating a plug for the strand which has a resettable circuit breaker or switch, which may be reset after an overload.

Figure 23:
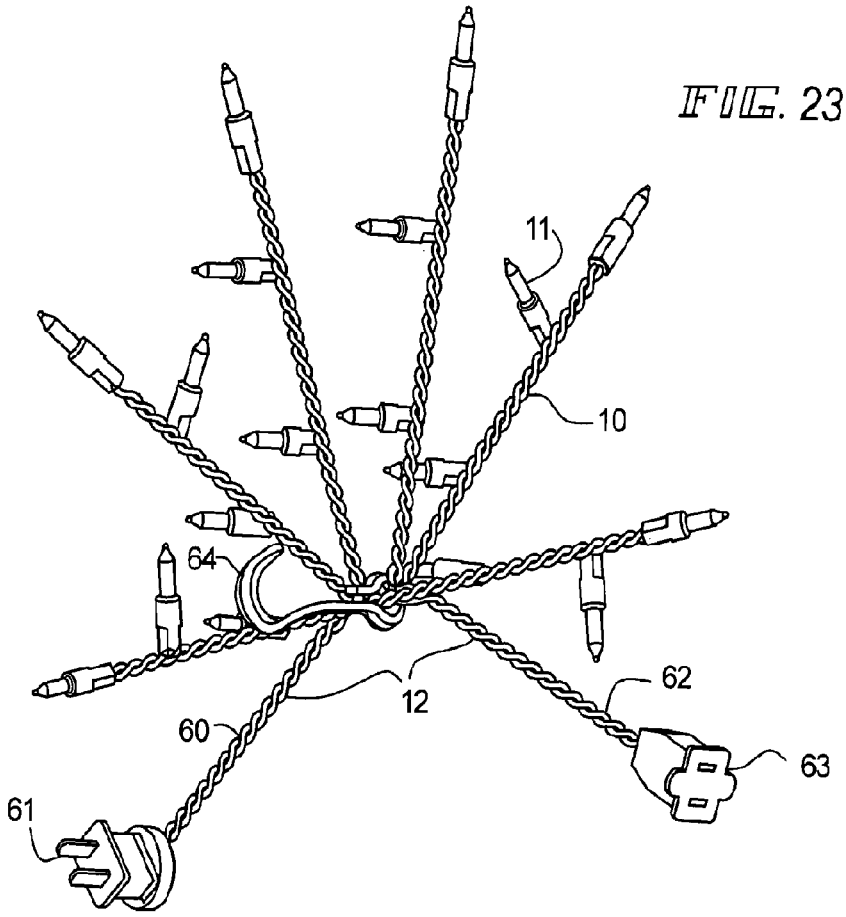

FIG. 23 is an elevational view showing a shorter strand of lights which may be used to decorate the top of a tree, and also having a modified hook for engaging the limb of a tree or a similar member.

Figure 24A:
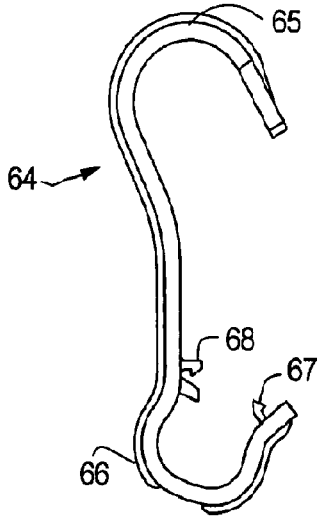
Figure 24B:
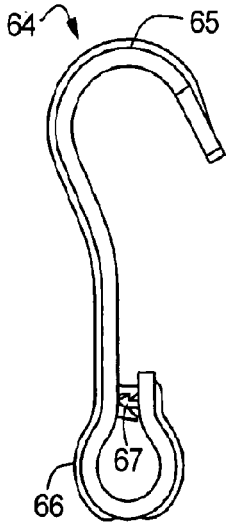
Figure 24C:
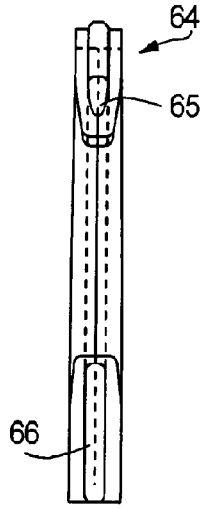

FIG. 24 are multiple views of the modified hook shown in FIG. 23, namely, depicted in FIG. 24A from one side in open condition, and similarly in FIG. 24B in closed condition, and in FIG. 24C in closed condition a right angle to FIG. 24B.

DESCRIPTION OF PREFERRED EMBODIMENTS

With reference to the accompanying drawings and particularly to FIGS. 1-3, a strand 10 of lamps 11 are arranged on electrical wires 12, and trained through a hub or spreader 13, which preferably may have a hook 14 for engaging a tree limb or other structure. A number of strands 10 may be bundled together through the hub 13, which pre-separates the wires. The hub may be used to stabilize the strand. A plug 15 and socket 16 for connecting the bundle of strands 10 to another bundle or strands and/or to a source of power may also be provided and arranged connected to the wires 12 through the hub 13 The lamps may be oriented relative to the wires 12 and hub 13, so that some lamps 11*a* are extended in the plane of the wires 12 and other lamps 11*b* are arranged in a plane perpendicular to the wires 12.

As shown in FIG. 3, the hub 13 may comprise a body 17 and a cover 18, which can be snapped together by means of barbed teeth 19. With reference to FIGS. 4 and 5, the body 17 may also have a series of upstanding ribs 20, which may be used to train and pre-separate the wires 12 of each strand 10 in a selected direction through the hub 13 in a manner so the wires 12 of each strand and those connecting the plug and socket lay in a predetermined selected position.

Figure 7:
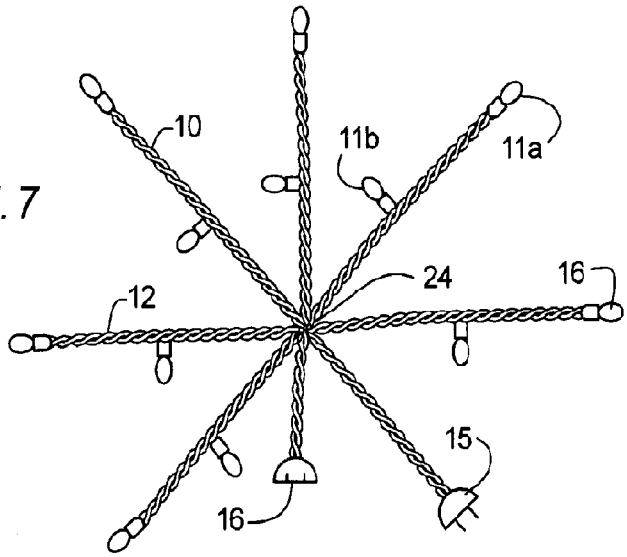
FIG. 7 is a top plan view similar to FIG. 1, except with the hub-like structure composed of twisted plastic fasteners.
Figure 6:
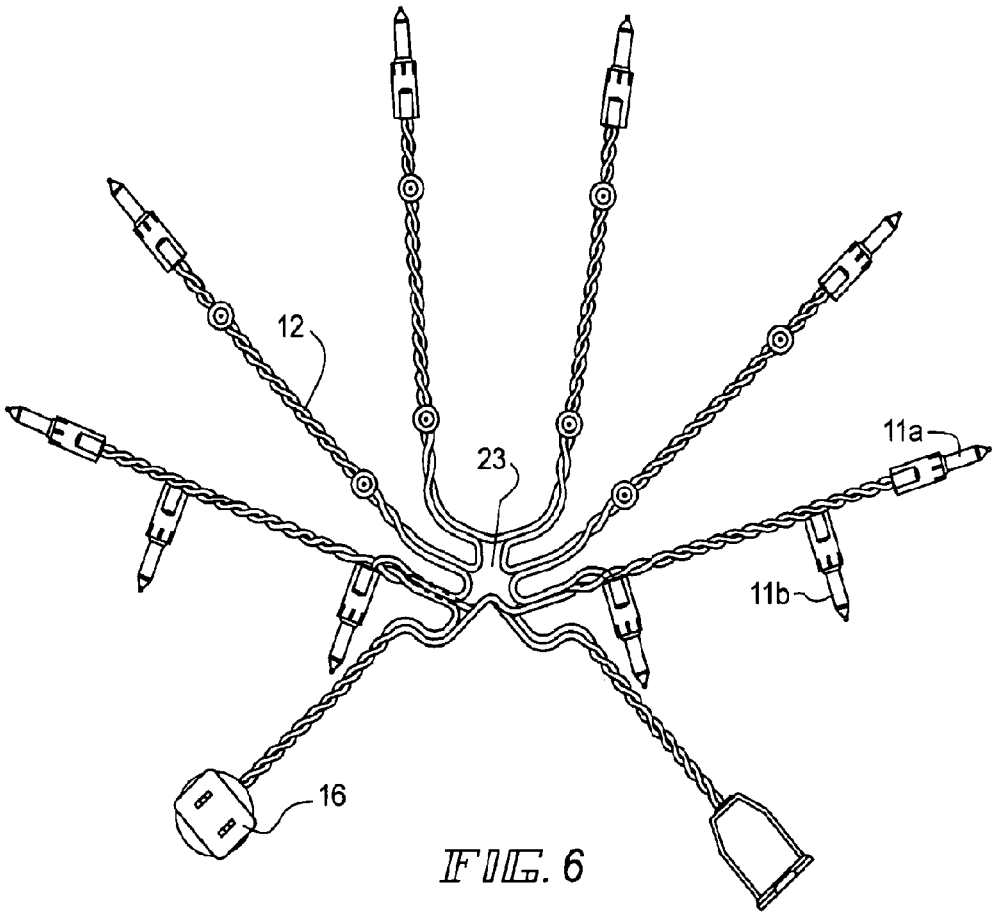
FIG. 6 is a top plan view similar to FIG. 1, except with the wiring arranged within a molded hub arrangement.

Alternatives to the hub and related structure shown in FIGS. 1-5 are depicted in FIGS. 6 and 7. In FIG. 6, the modified hub 23 comprises a molded piece which has the wires 12 secured therein. In FIG. 7, twisted plastic fastener connections 24 perform the function of the hub 13 to properly orient the wires 12 and lamps 11.

Figure 8:
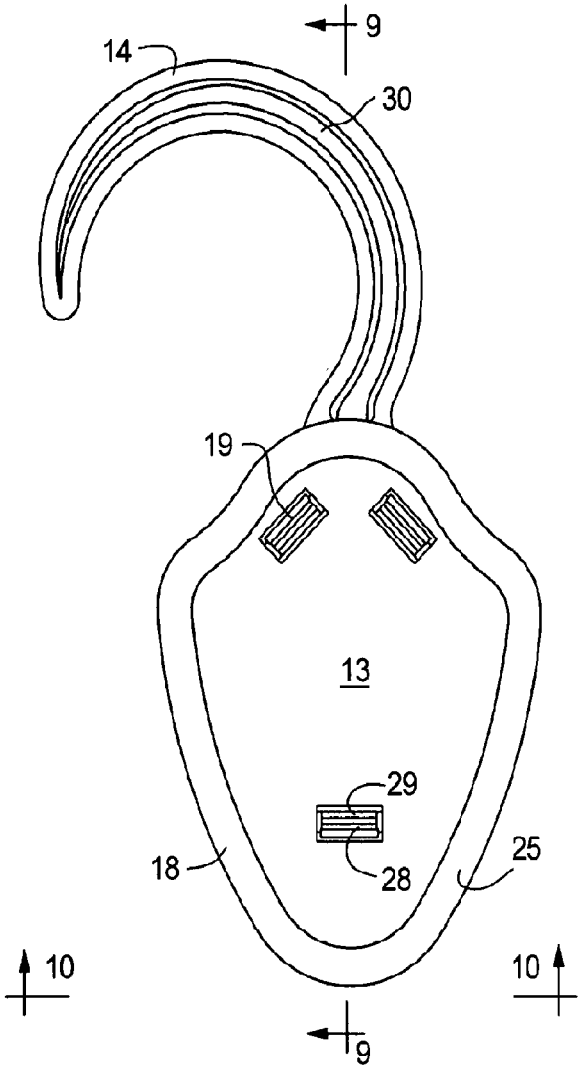
FIG. 8 is a side elevation view of the preferred hub and hook arrangement, like the arrangement shown in FIGS. 1-4.
Figure 9:
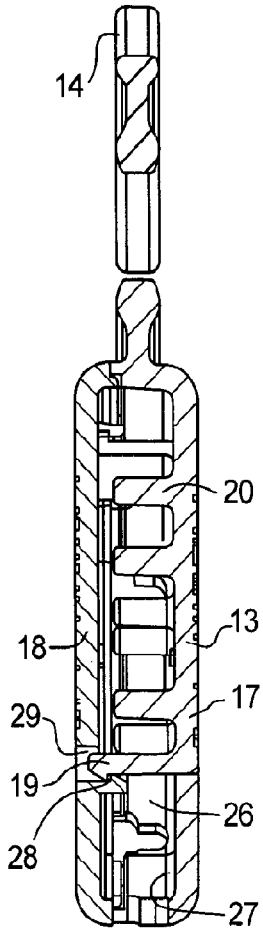
FIG. 9 is a cross-section view of the preferred hub and hook arrangement shown in FIG. 8, taken on line 9-9 of FIG. 8.
Figure 10:
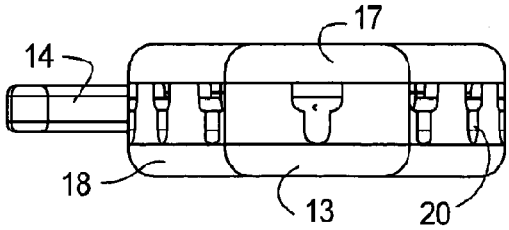
FIG. 10 is a cross-sectional view of the preferred hub and hook arrangement shown in FIGS. 8 and 9, taken on line 10-10 of FIG. 8.

FIGS. 8-10 depict details of the preferred hub 13, preferably made of plastic dielectric insulating material. The body 17 and its cover 18 may be pendant shaped with beveled sides 25 for easy handling, and of a size to accommodate the electric wires 12 in a recess 26 formed by the body 17 and cover 18 when closed. The ribs 20 are formed on the underside 27 of the body 17 and are of a size to reach the inside wall of the cover 18, so that the wires 12 when arranged in the recess 26 will stay in a selected position. The barbed teeth 19 are upstanding on the body 17 and may be snap engaged over cooperating teeth 28 into apertures 29 in the cover 18; and preferably there are multiple sets of these members to close the body 17 and cover 18, but they may be selectively manipulated to open the recess 26 for adjustment of the wires 12. The hook 14 preferably has a longitudinally extending central reinforcement 30 which permits it to be flexible without breaking. Preferably, the hook 14 and body 17 and cover 18 are molded from thermoplastic insulating materials, so that they protect the wires, even under stress when the hook 14 is assembled on a limb L of a tree or other member.

Alternate hub forms are shown in FIGS. 11-13. In FIG. 11, the hook 33 has a loop 34 through which each of the strands 10 extend; and in FIG. 12, each of the strands 10 extend from an apertured hook 43. In FIG. 13, the central restraining means for holding the bundle of strands 10 together is a sleeve 53 which is secured to or wrapped around the strands 10. In both the FIGS. 11 and 13 embodiments, during manufacture, the strands 10 may be extended on one side of the hook 33 or sleeve 53, to accommodate the length of a branch B as desired on which it may be mounted or to accomplish a design conceived of by the trimmer.

In each case, the hub or its equivalent 13 or 23 or 33 or 43 or 53 is removably secured around a limb L or post P and the strand(s) are extended outwardly substantially horizontally therefrom along a branch B or other structure. To remove the strand 10 from its limb L or post P, the hook-like member or its equivalent is merely backed up and the strand 10 is pulled from the branch B or the like. The bundle of strands 10 can be suspended by the hook-like member from a peg or rolled up for storage until its reused.

Figure 15:
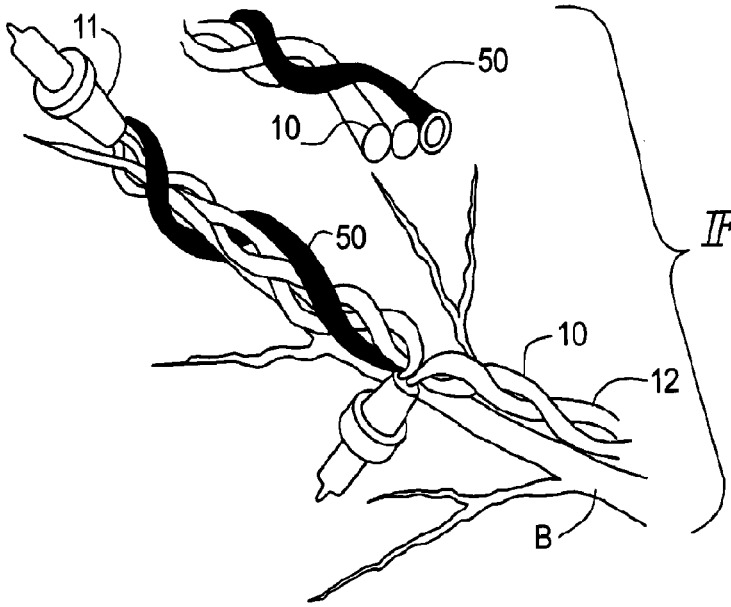
FIG. 15 is an enlarged view of the branch of the tree shown in FIG. 14 (with a permanent tie shown within the circle on a branch of FIG. 14 for securing the strand to a tree); and above and a part of this Figure is a sketch showing interwoven electric wires and a soft dielectric plastic tie for securing the wires to a branch.
Figure 14:
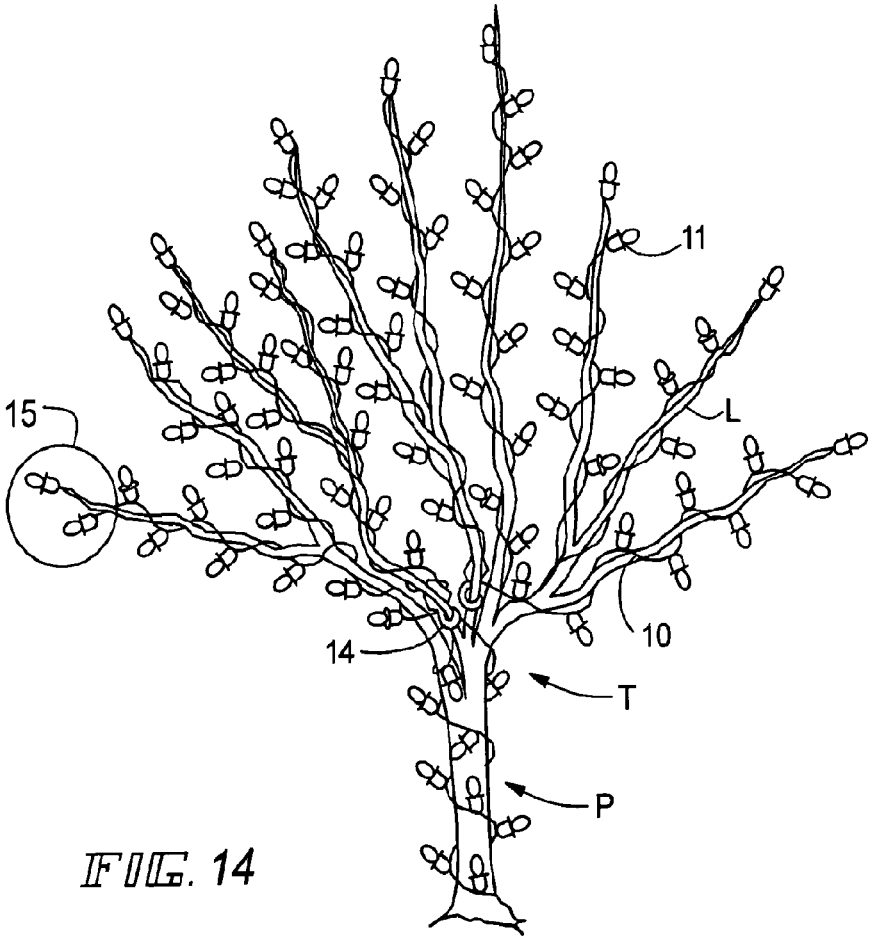
FIG. 14 is a elevation view of a trimmed tree, where the tree has been trimmed from branch to branch according to the method described in this application.
Figure 16:
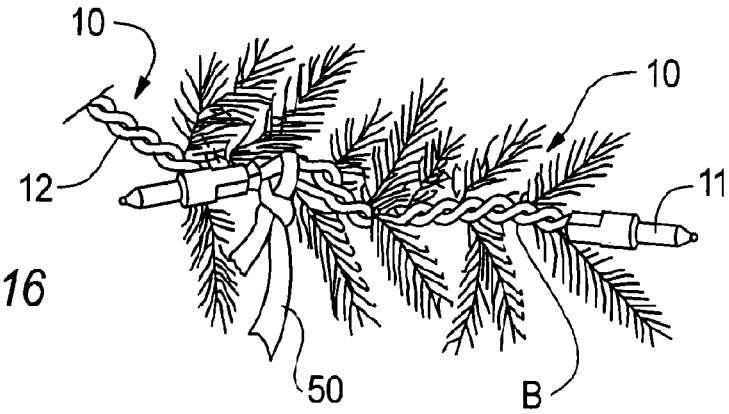
FIG. 16 is an enlarged view of a branch having a modified tie arrangement set next to a light, which is a modified means for securing a lamp or bulb and its light fixture to a branch.
Figure 16A:
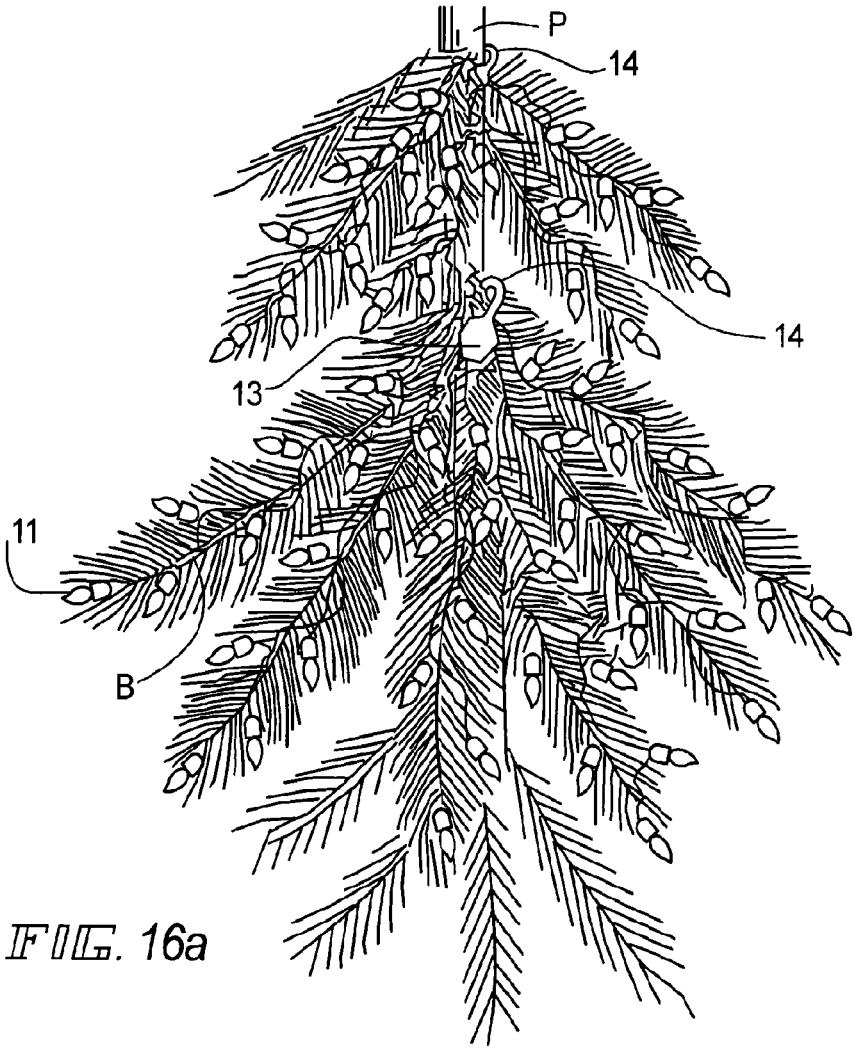

In FIGS. 14-16, a trimmed tree T is shown. With reference to FIG. 14, each strand 10 is connected by a hook 14 or the like from the trunk-like post P or a limb L and encircles the tree T outwardly from its center. Strands 10 may be connected together by means of their respective plugs and sockets, and a plug 15 at the end of a strand 10 may be exposed for connection to a source of power.

In FIG. 15, a branch B with the wires 12 of a strand 10 wound around it is shown, taken from the circle displayed in FIG. 14. Above and part of FIG. 15 is a sketch showing the electric wires 10 which may be interwoven with a soft plastic tie 50. The lamps 11 may be oriented as the decorator desires. FIG. 16 shows a modification of a strand 10 where the soft tie 50 or tape my be interconnected adjacent a lamp 11, so that the lamp may be bound and secured in a selected position on the limb L.

FIG. 17 illustrates another possibility using the novel structure and method disclosed in this application. The lamps 11 in this modification are arranged in lamp holders 51 or similar ornaments and are oriented to stand upward when arranged on a tree or other connected surface. In this embodiment decorative members such as small toys or dolls or other ornaments may be connected to a strand 10 and oriented like the lamp holders 51 in a selected predetermined position on the wires 12, with or without lamps. The arrangement of these ornaments may be predetermined on a strand before the strand 10 is positioned on a tree or other surface. The strand 10 need only be extended outwardly from the hub 13 and hook-like member 14 on a tree trunk T or a post to place the ornament or any special decoration in proper position.

In FIGS. 18 and 19, a strand 10*a* is shown connected to another strand 10*b* by means of the socket 16 and plug 17 arrangements previously describer. The strands 10 may be extended vertically along a tree trunk T or post, and the lamps 11 are aligned upright on a limb L or branch B. Each strand 10*a* has a hook-like member which may be engaged on the trunk T or post, to fully extend the stand in a vertical direction. A plug on the extreme end of a strand may be connected through a extension cord E or the like to a source of power. Likewise, as shown in FIG. 19, multiple light strands 10 may be removably secured on the trunk T or post and extended outwardly horizontally from the trunk T, with one part of the strand 10 connected to trunk T. To remove the strands from the trunk T, one need only disconnect the hook-like member 14 and pull the wires 12 and connected lamps 11 toward the hook-like member 14, where they can be conveniently bundled without tangling.

A typical circuit for a strand 10 is shown in FIG. 20. Note that each strand has wires 12 which connect the lamps 11 in series and the sets in parallel. This arrangement also permits multiple strands to be connected together through each socket 15 and plug/socket 16 of successive strands.

FIGS. 21 and 22 show a modified electrical arrangement where a two pole 52*a* and 52*b* circuit breaker or limit switch 52, which may have an optional ground 57. So long as the breaker or limit switch 52 is closed, power will flow through the wires 12 to the lamps 11. If there is a short or overload, the switch or circuit breaker 52 will open and power will be shut down before there is a dangerous overload or a fire hazard. The plug 15 or socket 16 can be provided with an exterior connection button 56 to the breaker or switch 52, so that a open switch can be closed by merely pressing the button once the cause of the overload or short is eliminated. Such an arrangement permits joining multiple strands 10 and the use of strands without danger of overload or fires or other electrical hazards.

As shown in FIG. 23, the wire configuration comprises six strands 10 of lamps 11 and two lengths of connecting wires 12, one length 60 having a male plug 61 and the other length 62 having a female socket 63, and these strands are secured together at their centers by a novel modified hook 64, discussed hereafter. The strands may be assembled into kits with strands 10 of different lengths and numbers of bulbs 11 for selected different applications. For example, when trimming a typical Christmas tree, a shorter length of strand 10 can be provided for the top of the tree and longer lengths of strands 10 can be used on the girth of the tree, and this arrangement makes for a neater assembly. The plug 61 and socket 63 of a strand 10 may be trained along the central limb of the tree, instead of dangling over the circumference, and the strand on each horizontal level of the tree may be electrically connected to an adjacent level and the lower level strand maybe connected to a source of power so that the connecting wires are not visible from the periphery of the tree.

The novel modified hook 64 shown in FIG. 24 is preferably molded from bendable plastic material, and comprises a hook portion 65 for connection to a limb, and a section 66 for encircling a bundle of strands 10 at any selected point along the length of strands, depending upon the surface to be decorated. This hook section 66 comprises a length of material preferably having a preformed radius, and has a barb 67 at one end and a receiving clip 68 at its other end, so that the barb may be connected to the clip for encircling a bundle of strands 10. When storing the strands 10 for the next year's use, the hook may be removed from the limb and the barb 67 may be released and removed from the clip 68, so that the strands may be conveniently stored and reused as desired, with minimum risk to the bulbs 11 and the wires 12.

Within recent years, pre-lit Christmas trees and similar pre-lit decorations have become popular, but on occasion one or more of the pre-lit lights require repair. In such an event, strands embodying the present invention may be utilized as a repair kit for such pre-lit devices. Such strands easily blend into the pre-lit device in a neat and attractive fashion.

While the novel decorative strands embodying the invention and the inventive method has been show in considerable detail and with many alternatives, it should be understood that other alternatives are possible without departing from the scope or spirit of the invention, and, accordingly, it is desired that the invention should not be limited to the exact construction, arrangement of parts and processes described.

The invention claimed is:

1. A decorative lighting system comprising:

a first set of three or more electrically interconnected light strands, each with a secured proximal end and terminating with a free distal end;

a first hub including:

a first closed hook that encircles and secures the proximal ends of each of three or more light strands of the first set of light strands in a predetermined position; and a first open hook, larger than the first closed hook, wherein the first open hook is configured to removably attach the decorative lighting system to a tree, and wherein each of the free distal ends of the three or more light strands of the first set of light strands are configured to extend along a tree branch;

a second set of three or more electrically interconnected light strands, each with a secured proximal end and terminating with a free distal end, wherein the second set of lights strands selectively electrically connects to the first set of light strands; and a second hub including:

a second closed hook that encircles and secures the proximal ends of each of three or more light strands of the second set of light strands in a redetermined position; and a second open hook, larger than the second closed hook, wherein the second open hook is configured to removably attach the decorative lighting system to the tree, and wherein each of the free distal ends of the different three or more light strands are configured to extend along a tree branch.

2. The decorative lighting system of claim 1, wherein the three or more light strands of each of the first and second sets of light strands are electrically interconnected at the secured proximal ends of each of the light strands.

3. The decorative lighting system of claim 1, wherein each of the light strands are approximately equal in length.

4. The decorative lighting system of claim 1, further comprising:

a first power strand with a proximal end secured by the first closed hook and a first free distal end, wherein the first free distal end includes a first power plug or receptacle; and a second power strand with a proximal end secured by the second closed hook and a second free distal end, wherein the second free distal end includes a second power plug or receptacle, wherein the first power plug or receptacle is selectively electrically connected to the second power plug or receptacle.

5. The decorative lighting system of claim 1, further comprising:

a first power strand with a proximal end secured by the first closed hook and a first free distal end, wherein the first free distal end includes a first power plug;

a second power strand with a proximal end secured by the first closed hook and a second free distal end, wherein the second free distal end includes a first power socket;

a third power strand with a proximal end secured by the second closed hook and a third free distal end, wherein the third free distal end includes a power plug; and a fourth power strand with a proximal end secured by the second closed hook and a fourth free distal end, wherein the fourth free distal end includes a power socket, and wherein one of the first and second power plugs and one of the first and second power sockets selectively electrically connect the first and second sets of light strands together.

6. The decorative lighting system of claim 1, further comprising:

three or more ties, wherein each of the ties are integral with a free distal end of one of the light strands and configured to removably attach a light strand to a tree branch.

7. The decorative lighting system of claim 1, wherein each of the first and second closed hooks include a barb and a receiving clip configured to selectively encircle and secure the proximal ends of each of three or more light strands.

8. The decorative lighting system of claim 1, wherein the light strands each include an array of regularly spaced lamps.

9. The decorative lighting system of claim 8, wherein the lamps are each arranged in an lamp holder and wherein each of the lamp holders are configured to stand upward.

10. The decorative lighting system of claim 1, wherein the three or more light strands of each of the first and second sets of light strands are formed from one or more continuous wires and the secured proximal ends of each of the three or more light strands occur at regularly spaced bundle points along the one or more continuous wires.

11. A decorative lighting system comprising:

a first set of three or more electrically interconnected light strands, each with a secured proximal end and terminating with a free distal end;

a first hub including:

a first body that orients the proximal ends of each of three or more light strands of the first set of light strands in a predetermined position;

a first cover that selectively attaches to the first body via one or more barbed teeth and in combination with the first body secures the proximal ends of each of three or more light strands of the first set of light strands in the predetermined position; and a first hook configured to removably attach the decorative lighting system to a tree, and wherein each of the free distal ends of the three or more light strands of the first set of light strands are configured to extend along a tree branch;

a second set of three or more electrically interconnected light strands, each with a secured proximal end and terminating with a free distal end wherein the second set of lights strands selectively electrically connects to the first set of light strands; and a second hub including:

a second body that orients the proximal ends of each of three or more light strands of the second set of light strands in a predetermined position;

a second cover that selectively attaches to the second body via one or more barbed teeth and in combination with the second body secures the proximal ends of each of three or more light strands of the second set of light strands in the predetermined position; and a second hook configured to removably attach the decorative lighting system to the tree, and wherein each of the free distal ends of the three or more light strands of the second set of light strands are configured to extend along a tree branch.

12. The decorative lighting system of claim 11, wherein the three or more light strands of each of the first and second sets of light strands are electrically interconnected at the secured proximal ends of each of the light strands.

13. The decorative lighting system of claim 11, wherein each of the light strands are approximately equal in length.

14. The decorative lighting system of claim 11, further comprising:

a first power strand with a proximal end secured by the first hub and a first free distal end, wherein the first free distal end includes a first power plug or receptacle; and a second power strand with a proximal end secured by the second hub and a second free distal end, wherein the second free distal end includes a second power plug or receptacle, wherein the first power plug or receptacle is selectively electrically connected to the second power plug or receptacle.

15. The decorative lighting system of claim 11, further comprising:

a first power strand with a proximal end secured by the first hub and a first free distal end, wherein the first free distal end includes a first power plug;

a second power strand with a proximal end secured by the first hub and a second free distal end, wherein the second free distal end includes a first power socket;

a third power strand with a proximal end secured by the second hub and a third free distal end, wherein the third free distal end includes a second power plug; and a fourth power strand with a proximal end secured by the second hub and a fourth free distal end, wherein the fourth free distal end includes a power socket, and wherein one of the first and second power plugs and one of the first and second power sockets selectively electrically connect the first and second sets of light strands together.

16. The decorative lighting system of claim 11, further comprising:

three or more ties, wherein each of the ties are integral with a free distal end of one of the light strands and configured to removably attach a light strand to a tree branch.

17. The decorative lighting system of claim 11, wherein the light strands each include an array of regularly spaced lamps.

18. The decorative lighting system of claim 17, wherein the lamps are each arranged in an lamp holder and wherein each of the lamp holders are configured to stand upward.

19. The decorative lighting system of claim 11, wherein the three or more light strands of each of the first and second sets of light strands are formed from one or more continuous wires and the secured proximal ends of each of the three or more light strands occur at regularly spaced bundle points along the one or more continuous wires.

* * * * *